United States Patent [19]

Beverly

[11] Patent Number: 4,671,419

[45] Date of Patent: Jun. 9, 1987

[54] ROD ASSEMBLY

[76] Inventor: Keith J. Beverly, c/o Beverly Coat Hanger Co., Inc., 1215 Fairfax Ave., San Francisco, Calif. 94124

[21] Appl. No.: 829,316

[22] Filed: Feb. 14, 1986

[51] Int. Cl.[4] ..... A47H 1/02

[52] U.S. Cl. ..... 211/105.1; 211/123; 248/343; 403/353

[58] Field of Search ..... 211/105.1, 123; 248/343, 340, 251, 222.2, 231.9; 160/323 R, 323 B; 403/353

[56] References Cited

U.S. PATENT DOCUMENTS

| | | | |
|---|---|---|---|
| 473,376 | 4/1892 | Briggs | 248/251 |
| 942,564 | 12/1909 | Ireland | 248/251 |
| 4,240,764 | 12/1980 | Wegner | 248/222.2 X |
| 4,474,299 | 10/1984 | Andrews | 211/123 X |

FOREIGN PATENT DOCUMENTS

| | | | |
|---|---|---|---|
| 459493 | 4/1968 | Switzerland | 211/105.1 |
| 2040679 | 9/1980 | United Kingdom | 211/105.1 |

*Primary Examiner*—Ramon S. Britts
*Assistant Examiner*—Blair M. Johnson
*Attorney, Agent, or Firm*—Poms, Smith, Lande & Rose

[57] ABSTRACT

A rod assembly adapted to be mounted underneath a shelf or ceiling having an elongated support bar for hanging thereon clothes or the like from hangers. The bar is supported at its mid position by a support member which provides firm support but allows the hangers to pass thereover without dislodgement if the hanger strikes the support member.

7 Claims, 5 Drawing Figures

Fig. 1.
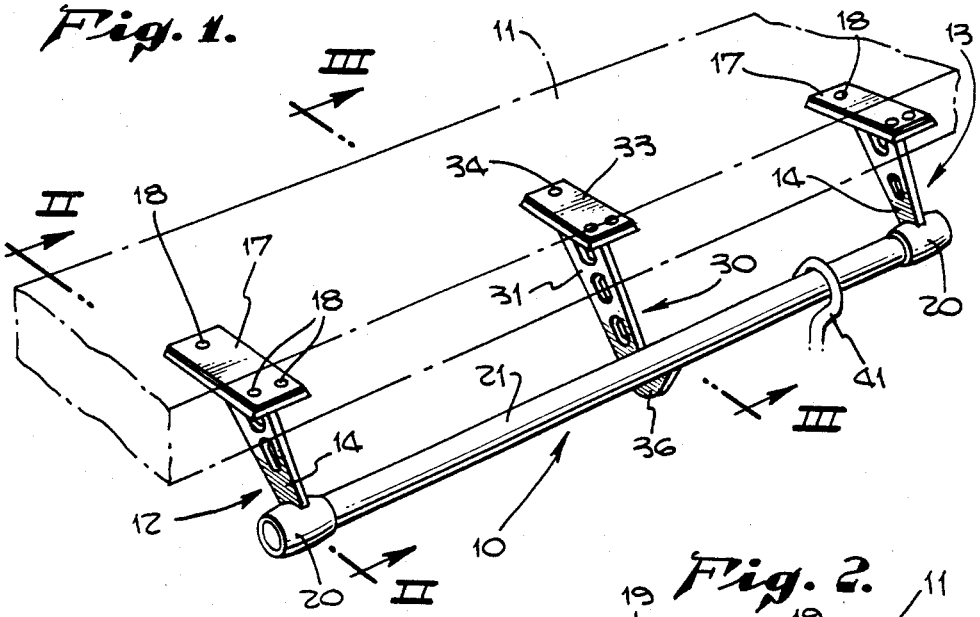
Fig. 2.
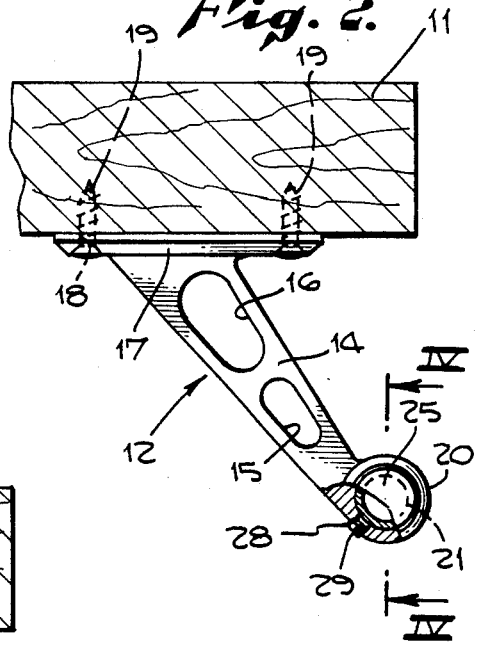
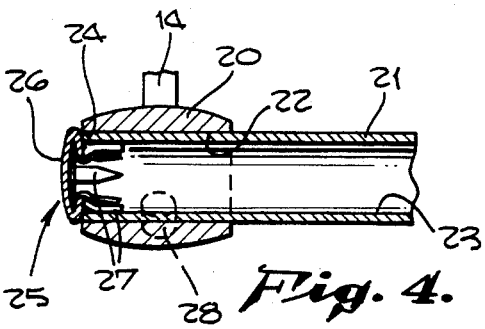
Fig. 4.
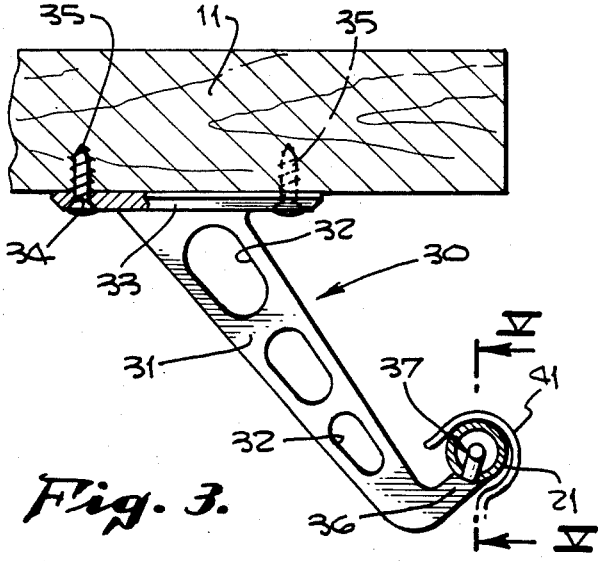
Fig. 3.
Fig. 5.
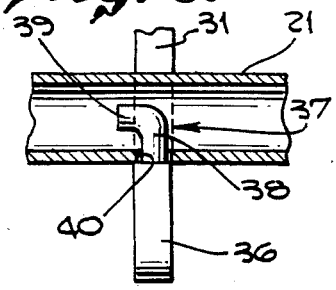

ROD ASSEMBLY

BACKGROUND OF THE INVENTION

1. Field of the Invention

The invention relates to rod assemblies; and, more particularly, to a rod assembly adapted to be mounted under a shelf or ceiling and receive hangers thereon.

2. Description of the Prior Art

Rod assemblies for hanging clothes or the like in a closet are well known in the art. There is a need for such assemblies which can be mounted under a shelf or ceiling and having an elongated tubular bar for receiving a plurality of hangers thereon. Many such assemblies have been suggested in the past. However, such assemblies take a considerable amount of weight since clothes are relatively bulky and heavy. Thus, various means have been suggested for assembling such devices and supporting them. For example, in U.S. Pat. No. 3,239,070, a hang rod assembly is disclosed. This assembly receives a mid support in the elongated tubular rod to support the same. However, an elongated channel must be formed in the rod to receive the support member which is expensive and weakens the rod. Further, hangers cannot slide along the rod past such support members.

U.S. Pat. No. 3,286,850 to Ruhnke discloses a similar arrangement and is likewise deficient. U.S. Pat. No 3,034,758 to Vagi shows a connector mechanism having a bracket connected to a shelf having a curved portion fitting into a pole. The parts cannot be quickly and easily disassembled, require careful machining of parts and do not allow hangers to move therepast.

There is thus a need for a rack assembly which can be quickly and easily manufactured, assembled and installed under a shelf or ceiling which provides firm mid support, yet allows hangers to move therepast.

SUMMARY OF THE INVENTION

It is an object of this invention to provide a rod assembly which can be mounted under a shelf or ceiling having firm mid support.

It is a further object of this invention to provide such a rod assembly which allows hangers to move along the rod thereof past the mid support.

It is still further an object of this invention to provide such a rod assembly where the hangers can move along the rod without dislodgement of the midsupport from the rod should the hanger strike the mid support.

These and other objects are preferably accomplished by providing a rod assembly adapted to be mounted underneath a shelf ceiling having an elongated support bar for hanging thereon clothes or the like from hangers. The bar is supported at its mid position by a support member which provides firm support but allows the hangers to pass thereover without dislodgement if the hanger strikes the support member.

BRIEF DESCRIPTION OF THE DRAWING

FIG. 1 is a perspective view showing the rod assembly of the invention mounted underneath a shelf or ceiling structure showing a portion of a conventional coat hanger mounted thereon;

FIG. 2 is a view taken along lines II—II of FIG. 1;

FIG. 3 is a view taken along lines III—III of FIG. 1;

FIG. 4 is a view taken along lines IV—IV of FIG. 2; and

FIG. 5 is a view taken along lines V—V of FIG. 3.

DESCRIPTION OF THE PREFERRED EMBODIMENT

Referring now to FIG. 1 of the drawing, a rod assembly 10 is shown mounted to the underside of a shelf 11. It is to be understood that assembly 10 can also be mounted to a ceiling or the like, if desired. Assembly 11 is comprised of a pair of end brackets 12, 13. Brackets 12 and 13 are identical and each, such as bracket 12 (see also FIG. 2), includes a flange 14, which may have one or more cut-out areas 15, 16 to reduce weight and for aesthetic reasons, extending from a mounting plate 17. Each mounting plate 17 includes a plurality of apertures or holes 18 therethrough (FIG. 1) for receiving screws 19 or the like (FIG. 3) for securing plate 17 to shelf 11. The other end of flange 14 terminates in a cylindrical member or collar 20 (see also FIG. 4) receiving therein one end of an elongated rod 21. Rod 21 is of course also cylindrical to conform to the inner cylindrical surface 22 of collar 20 and may be of any suitable configuration with the interior of collar 20 likewise configured to receive rod 21 telescopingly therein. Rod 21 is preferably hollow on its interior 23 (FIG. 4) and closed off at its open end 24 by an end cap 25 (FIG. 4). End cap 25 includes an outer flanged cap portion 26 having a plurality of resilient fingers 27 extending interiorly into rod 21 and thus resiliently retained therein. As seen in FIG. 2, a set screw 28, such as in allen-type set screw, may be provided threaded into an aperture 29 in collar 20 to screw rod 21 to collar 20. Also, as seen in FIG. 2, although collar 20 and flange 17 may be separate pieces secured to flange 14, preferably the entire end bracket 12 is one integral piece.

As seen in FIG. 1, rod 21 extends between collars 20 in each end bracket 12, 13 as shown. In use, it is desirable, and necessary when rod 21 is relatively long and/or great weight is placed thereon, to provide some mid support for the rack assembly 10. Thus, one or more mid support brackets, such as bracket 30, may be provided on rack assembly 10. Bracket 30 (see also FIG. 3) includes a flange 31 preferably having one or more cut-out sections 32 leading from a mounting plate 33. Plate 33 includes a plurality of holes 34 (FIG. 1) receiving therein screws 35 (FIG. 3). Flange 31 terminates in an upwardly curved end 36 extending generally normal to the longitudinal axis of flange 31 having a L-shaped cylindrical pin 37 (FIG. 5) mounted thereon. Pin 37 thus includes a first elongated portion 38 secured to end 36 and preferably extending at a slight angle thereto and a second angled portion 39 extending from portion 38, preferably normal to the axis thereof. As seen in FIG. 5, rod 21 has a hole or aperture 40 in the wall thereof, preferably in its undersurface, with pin 37 received therethrough (FIG. 5). In assembling bracket 30 to rod 21 preferably after assembly of end brackets 12, 13 thereon, angled portion 39 is inserted into hole 40 (with the remaining portion of bracket 30 extending on the same side of rod 21 as brackets 12, 13,) then bracket 30 is twisted so that angled portion 39 has its longitudinal axis extending parallel to the longitudinal axis of rod 21 (FIG. 5). In this manner, bracket 30 is quickly and easily secured to rod 21.

As seen in FIGS. 1 and 3, a portion of a conventional coat hanger (not shown), such as hook portion 41, is shown disposed on rod 21. As seen in FIG. 3, hook portion 41 can slide along rod 21 and past bracket 30 without being obstructed thereby. Also, the positive lock provided by pin 37 and hole 40 does not result in dislodgement of the bracket 30 from rod 21 should the hanger hook or the operator's hand abut thereagainst. Thus, the bar 21 can't be lifted up and the angled pin 37 stops bar 21 from coming off bracket 30 if it is hit. Once bracket 30 is installed as heretofore disclosed, it must be twisted off to remove it from bar 21.

Bracket 30 can also be of separate interconnected parts but preferably is of one piece. Also, any suitable materials may be used, such as the various plastics, wood, metals, etc.

The rack assembly disclosed herein is a complete unit and can be quickly and easily put together and installed. The unique suspension for mid bracket 30 assures adequate strength and support for the bar 21 while providing for unobstructed hanger movement for the entire length of rod 21 between the end brackets 12, 13.

The invention herein results in a lightweight inexpensive assembly and eliminates the need for a solid bar. The rod 21 may be of a relatively small diameter yet won't collapse when carrying a heavy load.

There is thus disclosed a unique closet rod assembly which can be quickly and easily manufactured, assembled and installed yet provides great support and enables a plurality of coat hangers to be mounted thereon without interference from the mid support. In addition, accidental dislodgement of the rod from the mid support bracket is prevented.

I claim:

1. In a closet rod assembly having an elongated horizontally extending rod adapted to receive thereon a plurality of coat hangers supported at each end by a pair of brackets adapted to be mounted to a support structure, the improvement which comprises:

a mid support on said assembly between said pair of brackets having an elongated main body portion with a first elongated member extending at an angle therefrom, a second elongated member extending from said first elongated member and an angled portion having a longitudinal axis extending normal to said second elongated member, said rod being hollow and having a single hole in the body thereof on the underside thereof between said pair of brackets receiving therein a portion of said second elongated member and said angled portion, said angled portion having its longitudinal axis extending generally parallel to and generally coincident with the longitudinal axis of said rod with the longitudinal axis of said second elongated member extending, the area above said rod at said point of connection of said mid suopprt thereto being free from obstruction whereby the hooks of coat hangers can slide along said rod past said mid support without engagement therewith.

2. In the rod assembly of claim 1 wherein said mid support includes a mounting plate adapted to be secured to a support surface and said main body portion is a flange extending downwardly and away from said mounting plate, said first elongated member extending from said flange at an angle with respect to the central longitudinal axis of said flange.

3. In the assembly of claim 2 wherein said hole is circular and said second elongated member is a generally cylindrical pin extending from said first mentioned cylindrical pin.

4. In the assembly of claim 3 wherein said angled portion extends at an angle of about 90 degrees to the longitudinal axis of said first mentioned pin.

5. In the assembly of claim 4 wherein each of said pair of brackets includes a mounting plate adapted to be secured to a support surface, a flange extending from said plate and a hollow generally cylindrical collar secured to said flange, said rod being receivable in said collars and secured thereto.

6. In the assembly of claim 5 wherein said rod is secured to said collars by set screws.

7. In the assembly of claim 5 wherein said rod is closed off at each end by caps snap fitting into the open ends of said rod.

* * * * *